US010245629B1

(12) United States Patent
Skelton et al.

(10) Patent No.: US 10,245,629 B1
(45) Date of Patent: Apr. 2, 2019

(54) HAND TOOL FOR PAINTLESS DENT REPAIR

(71) Applicants: Keith Allen Skelton, Salado, TX (US); Leticia Egger Skelton, Salado, TX (US)

(72) Inventors: Keith Allen Skelton, Salado, TX (US); Leticia Egger Skelton, Salado, TX (US)

( * ) Notice: Subject to any disclaimer, the term of this patent is extended or adjusted under 35 U.S.C. 154(b) by 0 days.

(21) Appl. No.: 15/955,465

(22) Filed: Apr. 17, 2018

Related U.S. Application Data

(60) Provisional application No. 62/588,299, filed on Nov. 17, 2017.

(51) Int. Cl.
*B21J 13/02* (2006.01)
*B21D 1/06* (2006.01)
*B21D 1/12* (2006.01)

(52) U.S. Cl.
CPC *B21D 1/06* (2013.01); *B21D 1/12* (2013.01)

(58) Field of Classification Search
CPC ..... B21D 1/06; B21D 1/12
USPC ..... 72/460
See application file for complete search history.

(56) References Cited

U.S. PATENT DOCUMENTS

| | | | | | |
|---|---|---|---|---|---|
| 2,054,248 | A * | 9/1936 | Eronen | B21D 1/06 | 72/447 |
| 2,352,009 | A * | 6/1944 | Robbins | B21D 1/06 | 72/211 |
| 2,435,726 | A * | 2/1948 | Rohde | B21D 1/06 | 72/470 |
| 2,539,040 | A * | 1/1951 | Sparhawk | B21D 1/06 | 72/319 |
| 2,600,723 | A * | 6/1952 | Back | B21D 1/06 | 72/412 |
| 5,333,486 | A * | 8/1994 | Ishihara | B21D 1/06 | 72/391.2 |
| 5,479,804 | A * | 1/1996 | Cook | B21D 1/06 | 33/608 |
| 6,014,885 | A * | 1/2000 | Griffaton | B21D 1/06 | 72/453.16 |
| 6,957,561 | B1 * | 10/2005 | Contreras | B21D 1/06 | 72/458 |
| 7,104,108 | B2 * | 9/2006 | Roche | B21D 1/06 | 72/458 |
| 8,250,899 | B2 * | 8/2012 | Janversan | B21D 1/06 | 72/325 |

* cited by examiner

*Primary Examiner* — David B Jones

(57) ABSTRACT

This invention is a hand tool for paintless dent repair on metal panels of vehicles, in which the dented area is located around the edges of said panels, and comprises two curved handle bars flexibly attached by a mechanical fastener, wherein the upper extremity of one handle bar is connected to a u-shaped plate which has its outer surface adhesively fastened to a u-shaped plate cover, and wherein the upper extremity of the other handle bar is shaped as a rounded smooth tip, with said tip inverted and facing the outer surface of the u-shaped plate cover.

6 Claims, 2 Drawing Sheets

HAND TOOL FOR PAINTLESS DENT REPAIR

BACKGROUND OF THE INVENTION

This invention relates to the repair of minor dents or minor body damage in the sheet metal of vehicles, and more particularly to tools which can be effectively used in the field of paintless dent repair, i.e., a specialized technique of metalworking that repairs small dents without repainting the damaged area. Many different sheet metal objects may be repaired using this technique, and the most common of which is automobile bodies whenever they are damaged by hail or minor impacts. Conventional auto body repair of dented metal generally involves the costly and time-consuming use of surface preparation chemicals, sanders, body fillers, paint, and a variety of equipment to accomplish this repair. Nevertheless, in case the finish on the dented metal is not compromised and the severity level of the damage allows for paintless dent repair, the advantages of paintless dent repair, in lieu of conventional auto body repair, are significantly superior, as paintless dent repair constitutes a time-saving and cost-efficient repair, all the while preserving the original paint of the vehicle, and, thus, avoiding a depreciation of the resale value of said vehicle. Furthermore, most paintless dent repair tools and processes conform to the principles of 'Green Engineering', which aims to improve, innovate, and invent technologies to achieve sustainability, minimize depletion of natural resources, strive to prevent waste, and ensure that all material and energy inputs and outputs are as inherently safe and benign as possible, while protecting human health and well-being.

BRIEF SUMMARY OF THE INVENTION

This invention is a hand tool for paintless dent repair on metal panels of vehicles, wherein the dented area is located around the edges of said panels, and comprises two curved handle bars flexibly attached by a mechanical fastener, wherein the upper extremity of one handle bar is connected to a u-shaped plate which has its outer surface adhesively fastened to a u-shaped plate cover, and wherein the upper extremity of the other handle bar is shaped as a rounded smooth tip, with said tip inverted and facing the outer surface of the u-shaped plate cover.

A general object of this invention is to provide an affordable, portable and flexible paintless dent repair hand tool adapted for removing dents from more or less curved sheet metal panels of vehicles, particularly in areas located around the edges of these panels, which generally are of difficult access and present challenges to paintless dent repair due to the inherently unique curvature and design of such sheet metal panels.

DETAILED DESCRIPTION OF THE INVENTION

Figure 1:
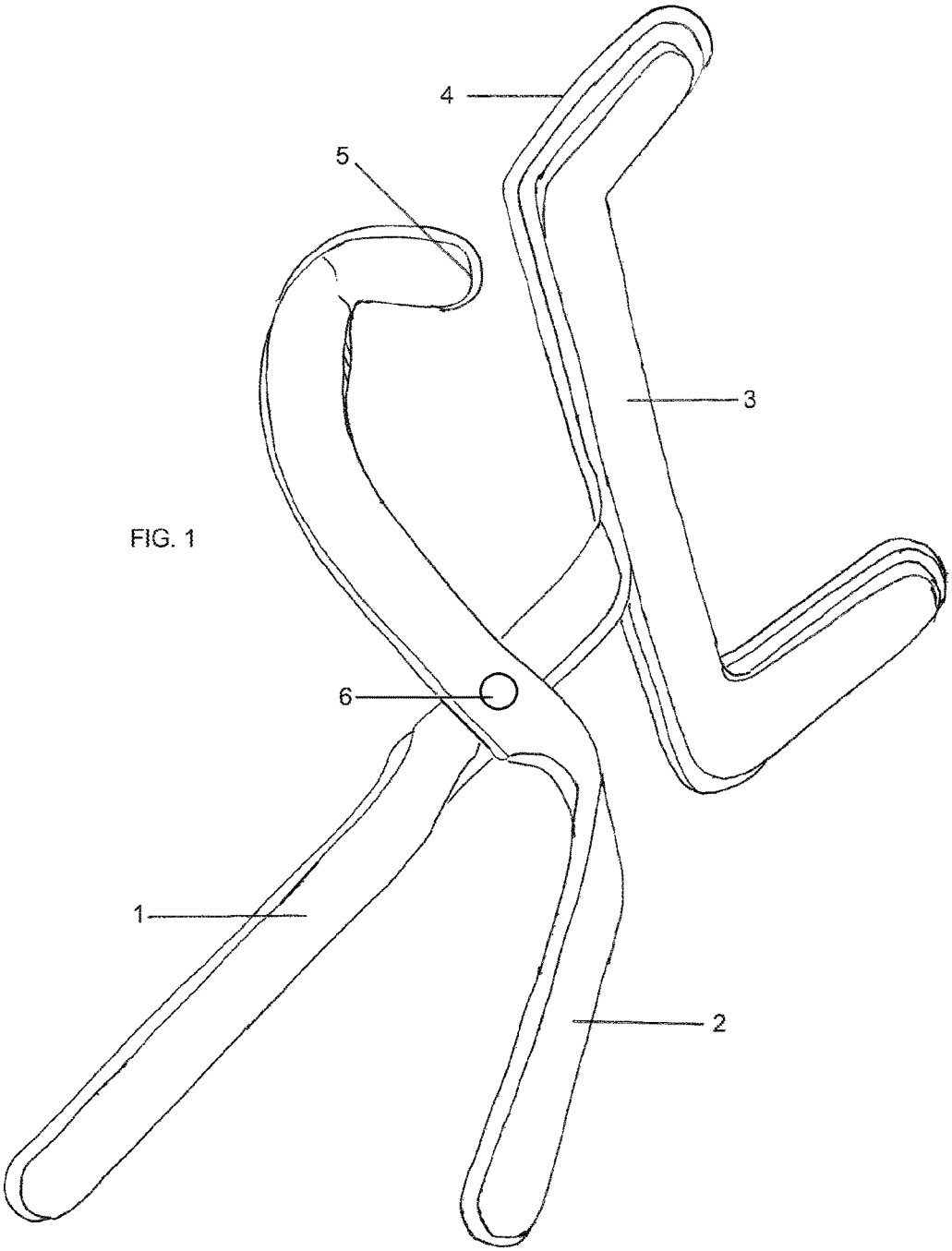
FIG. 1 illustrates a perspective view of a preferred embodiment of a paintless dent repair hand tool in accord with the herein described invention.
Figure 2:
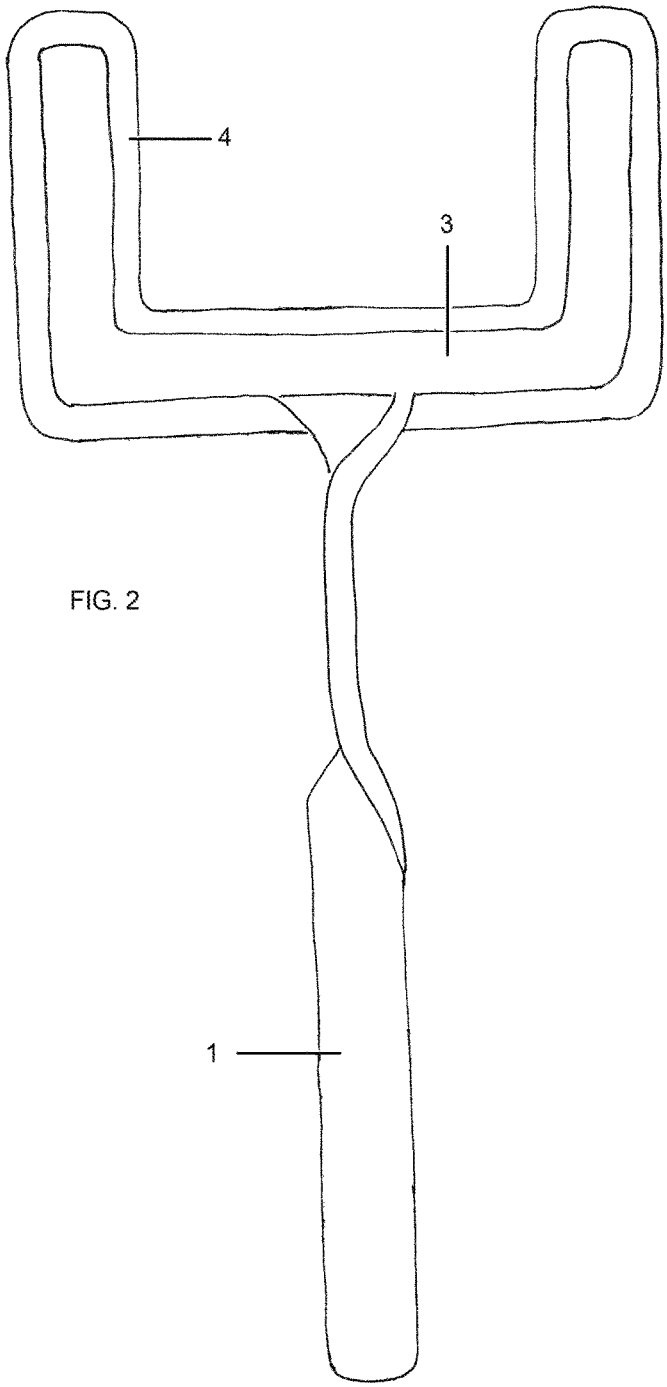
FIG. 2 illustrates a top view of one of the handle bars having its upper extremity connected to a u-shaped plate, which has its outer surface adhesively fastened to a u-shaped plate cover.
Figure 3:
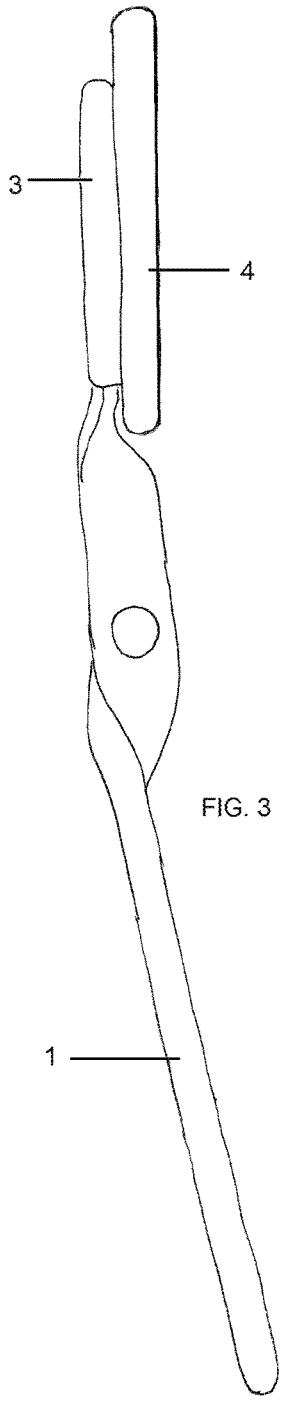
FIG. 3 illustrates a side view of the same handle bar shown in FIG. 2.

This invention is a hand tool for paintless dent repair on metal panels of vehicles, wherein the dented area is located around the edges of said panels, and this invention comprises: two curved handle bars 1 and 2 flexibly attached by a mechanical fastener 6, wherein the upper extremity of one handle bar 1 is connected to a u-shaped plate 3, which has its outer surface adhesively fastened to a u-shaped plate cover 4, and wherein the upper extremity of the other handle bar 2 is shaped as a rounded smooth tip 5, with said tip 5 inverted and facing the outer surface of the u-shaped plate cover 4.

In the operation of the paintless dent repair tool, it will be understood that the handles 1 and 2 are spread apart sufficiently to permit the tool to be placed upon opposite sides of the dented metal panel, i.e., by inserting the rounded smooth tip 5 on the inside of the vehicle metal panel, directly underneath the dent, and placing the outer surface of the u-shaped plate cover 4 on the outside of the vehicle metal panel, directly around the center of the dent to provide leverage and hold the tool in the above described position to initiate paintless dent repair.

After properly positioning the working parts, i.e., the round smooth tip 5 and the u-shaped part of handle 1, in the above described correlation to the dent or depression in the sheet metal, the handle bars 1 and 2 are operated to produce the necessary pressure of the smooth round tip 5 on the inside of the dented metal panel so as to lift up or raise the dent, and, henceforth, the tool may be moved to the next low spot of the dent and operated in the above described manner until the metal is straightened to the point in which the dent is no longer noticeable.

One advantage of the tool is the preferred curvature of handles 1 and 2, in that said curvature allows for the full extension of the said tool handle bars without their contact with any components which might be present in the inner panel area, such as tires under a fender panel, thus preventing possible damage to any of the before mentioned components.

If not otherwise expressed, those skilled in the art will readily determine the function and operation of the components comprised, illustrated and described herein without unnecessary additional description.

The components or parts of said tool may be made of a material selected from any of the following groups of Engineering materials: ceramic, composite, metal, and polymer.

To avoid damage to the finish on the metal panel during the paintless dent removal process, the said u-shaped plate cover should preferably have a non-marring outer surface made of a material selected from any of the following groups of Engineering materials: ceramic, composite, metal, and polymer.

The lower portions of both handle bars 1 and 2 may have a padded non-slip surface to allow for better grip and control.

While we have herein shown and described a preferred embodiment of the invention and certain structural features thereof, the tool may be changed or modified as desired, provided that the herein described performance for the paintless dent removal is successfully achieved by the paintless dent repair hand tool and without departing from the spirit and scope of the invention as set forth within the scope of the appended claims.

We claim:

1. A hand tool for the paintless dent repair of a dented metal panel of a vehicle, comprising:

a first curved handle bar having a first upper extremity, a first lower extremity, and a first lower portion surface on which a handgrip is located;

a u-shaped plate connected to the upper extremity of the first curved handle bar, a u-shaped plate cover adhesively fastened to the u-shaped plate, having an outer surface;

a second curved handle bar having a second upper extremity, a second lower extremity, and a second lower portion surface on which a handgrip is located, wherein the second upper extremity is shaped in the form of a rounded smooth tip facing the outer surface of the u-shaped plate cover; and a mechanical fastener flexibly attaching the first curved handle bar to the second curved handle bar, so as to produce a necessary pressure of the rounded smooth tip on an inside of the dented metal panel to lift up or raise a dent on said dented metal panel.

2. The hand tool of claim 1, wherein the first curved handle bar, the u-shaped plate, the u-shaped plate cover, the second curved handle bar, and the mechanical fastener of said tool are made of a material selected from a group of Engineering materials consisting of: ceramic, composite, metal, and polymer.

3. The hand tool of claim 1, wherein the outer surface of the u-shaped plate cover is made of a non-marring material selected from a group of Engineering materials consisting of: ceramic, composite, metal, and polymer.

4. The hand tool of claim 1, wherein both the first and the second curved handle bars have a padded non-slip lower portion surface extending from an end of the first and of the second lower extremities of said handle bars up to where said handle bars are flexibly attached by the mechanical fastener, so as to allow for better grip and control of said handle bars.

5. The hand tool of claim 4, wherein the padded non-slip surface of both the first and the second curved handle bars is made of a material selected from a group consisting of: ceramic, composite, metal, and polymer.

6. The hand tool of claim 1, wherein the first curved handle bar, the second curved handle bar and the u-shaped plate are made of a metal, wherein a pressure required to plasticaly deform said handle bars and u-shaped plate is greater than a pressure required to straighten the dented metal panel.

* * * * *